US005207571A

United States Patent [19]

Greenvurcel

[11] Patent Number: 5,207,571

[45] Date of Patent: May 4, 1993

[54] CANDELABRUM

[76] Inventor: Yaakov Greenvurcel, Houtzot Hayotzer, Studio 28, Jerusalem, Israel

[21] Appl. No.: 742,865

[22] Filed: Aug. 9, 1991

[30] Foreign Application Priority Data

Aug. 20, 1990 [IL] Israel ..... 95433

[51] Int. Cl.[5] ..... F21V 35/00

[52] U.S. Cl. ..... 431/295; 431/289; 362/250; 248/225.1; 248/346; 248/912

[58] Field of Search ..... 431/125, 289, 295; 362/392, 393, 388, 410, 450, 382, 431, 810, 161, 250, 252; 248/225.1, 346, 912; 446/127, 118; 211/162

[56] References Cited

U.S. PATENT DOCUMENTS

| | | | |
|---|---|---|---|
| Re. 17,987 | 3/1931 | Ferree et al. | 362/410 X |
| 1,213,690 | 1/1917 | Quinones | 446/118 X |
| 2,465,684 | 3/1949 | Heintze | 431/295 X |
| 2,643,840 | 6/1953 | Lanman | 211/162 X |
| 3,561,683 | 2/1971 | Dragan | 362/388 X |
| 3,605,323 | 8/1969 | Fisher | 446/127 X |
| 4,915,033 | 4/1990 | Bond | 248/346 X |
| 4,927,020 | 5/1990 | Randy | 248/225.1 |

FOREIGN PATENT DOCUMENTS

| | | | |
|---|---|---|---|
| 561354 | 5/1944 | United Kingdom | 431/295 |
| 894373 | 4/1962 | United Kingdom | 362/382 |

*Primary Examiner*—Carl D. Price
*Attorney, Agent, or Firm*—Natter & Natter

[57] ABSTRACT

A variable-configuration candelabrum including a base provided with a plurality of constraining grooves, and a plurality of stems, each of which has a first end configured to match the configuration of the constraining grooves and a second end provided with a candle holder. The constraining grooves are adapted to engage the ends of the stems allowing the movement of each of the stems into a plurality of positions on the base, while preventing vertical and tilting movement of the stems.

7 Claims, 3 Drawing Sheets

FIG. 1
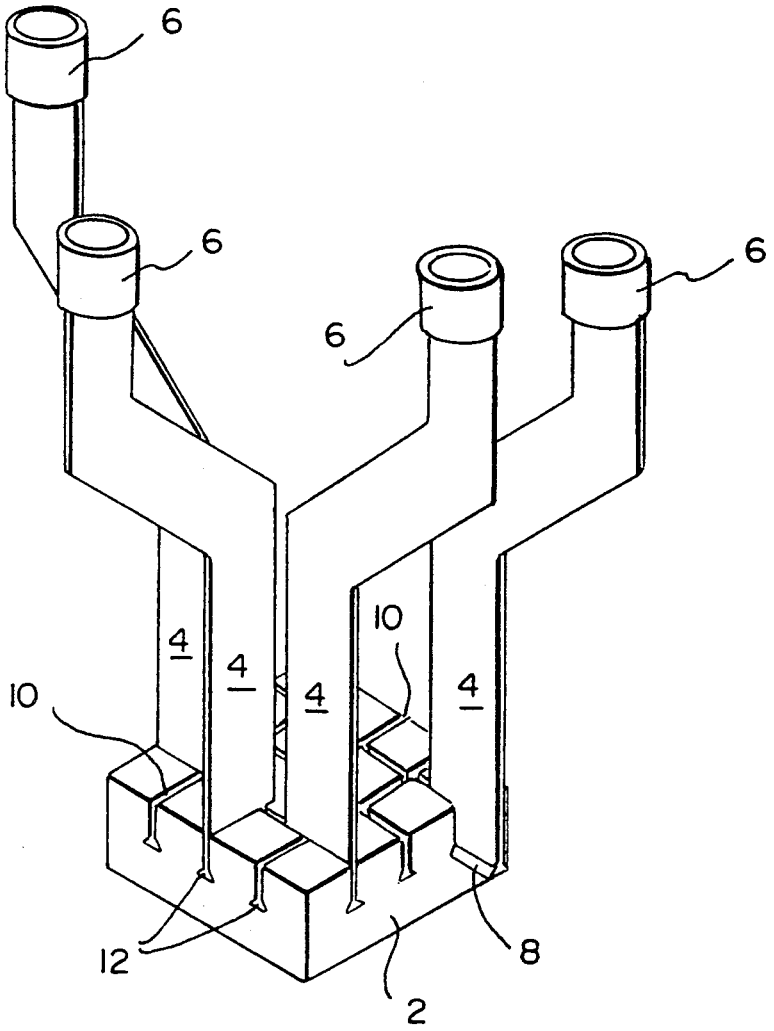
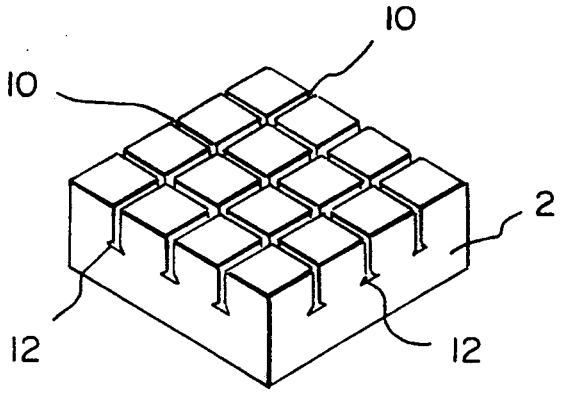
FIG. 2

CANDELABRUM

BACKGROUND OF THE INVENTION

1. Field of the Invention

The present invention relates to a multi-stem candelabrum, and more particularly, to a variable-configuration multi-stem candelabrum.

2. Description of Related Art

There are known candelabra comprising several components which can be temporarily or semi-permanently connected to each other, but all of these candelabra have a configuration which, if at all, can be modified only by skilled personnel and/or by using special tools, and whatever modifications are possible take a relatively long period of time.

SUMMARY OF THE INVENTION

It is one of the objects of the present invention to provide a candelabrum which can take on various configurations according to the desire and creative imagination of a user, who can adapt the candelabrum to different interiors, light, situation, mood, etc.

It is another object of the present invention to provide a candelabrum which can be assembled and disassembled within a short time.

It is yet another object of the present invention to provide a candelabrum which makes it possible not only to alter the relative positions of the candles but also to change the entire appearance of the candelabrum.

According to the invention this is achieved by providing a variable-configuration candelabrum comprising a base provided with a plurality of constraining means of a first type, and a plurality of stems, each of which has a first end provided with constraining means of a second type matching said constraining means of the first type of said base, and a second end provided with means for holding candles, said constraining means of the first type being adapted to engage said constraining means of the second type, allowing a user to move each of said stems into a plurality of positions on said base, while preventing vertical and tilting movement of said stems.

The invention will now be described in connection with certain preferred embodiments, with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

In the drawings:

FIG. 1 is a perspective view of a candelabrum according to the invention;

FIG. 2 shows the base of a candelabrum according to the invention, provided with undercut slots parallel to the sides of the base;

DESCRIPTION OF THE PREFERRED EMBODIMENTS

Figure 3:
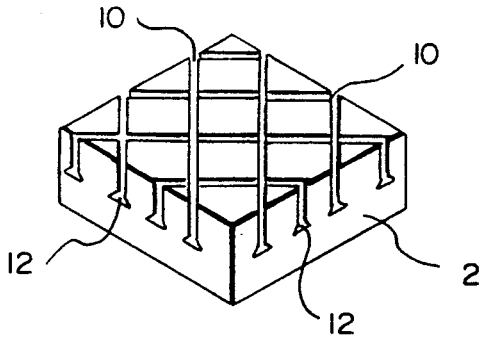
FIG. 3 illustrates another base of a candelabrum according to the invention having undercut slots parallel to the diagonals of the base.
Figure 4A:
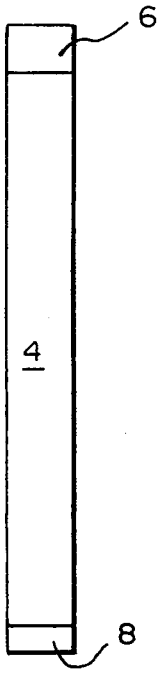
FIGS. 4*a–d* are frontal views of four different configurations of the flat, detachable stems.
Figure 4B:
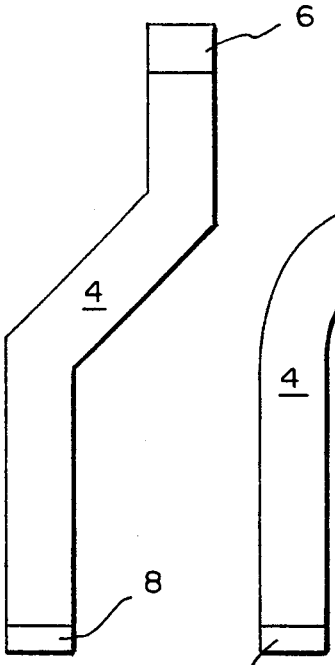
Figure 4C:
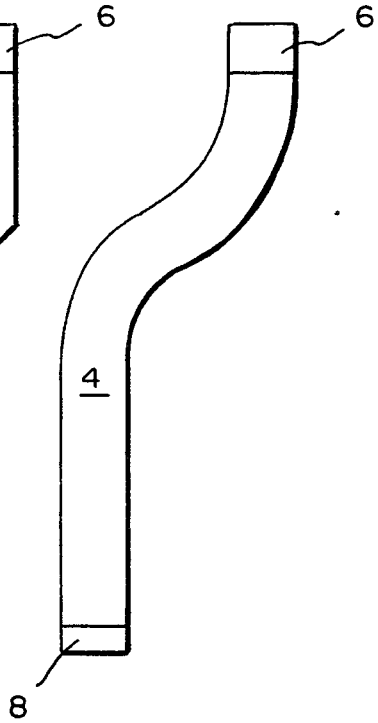
Figure 4D:
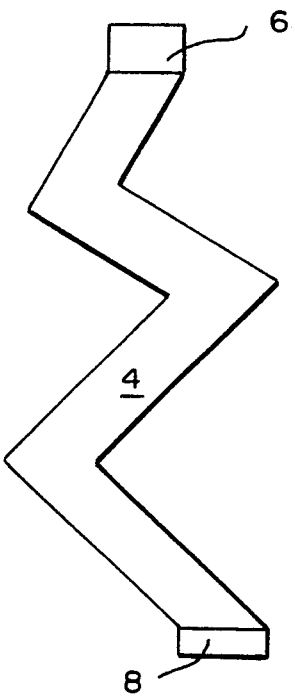

Referring now to the drawings, there is seen in FIG. 1 a four-stem candelabrum comprising a prismatic base 2 and four flat stems 4, to each of which are fixedly attached (e.g., by brazing) a candleholder 6 at one end and an anchoring member 8 at the other. The candleholders 6, shown here as simple cylindrical pieces with bores suited for commercially available candles, can obviously have other shapes such as conical, calyx-like, etc. The anchoring members 8 will be discussed further below. Instead of the anchoring members being separate, they could also be integral parts of the stems.

FIGS. 2 and 3 illustrate two types of simple bases 2, in which a grid-like pattern of mutually perpendicular slots 10 of substantial depth is cut across the upper surface. The bottom region of the slots 10 has the form of an undercut 12 which may have various cross-sectional shapes. In FIGS. 2 and 3, these shapes are dovetail-like. Obviously the anchoring members must slidingly fit these undercuts. This is clearly seen in FIG. 1, where the stem 4 at the extreme right and its dovetail-shaped anchoring member 8 are shown as being about to be fully pushed into (or pulled out from) the slot 10 in which they are partly inserted.

While in the base 2 of FIG. 2 the slots 10 are parallel to the respective sides of the base, in the base of FIG. 3 they are parallel to the respective diagonals.

Figure 5:
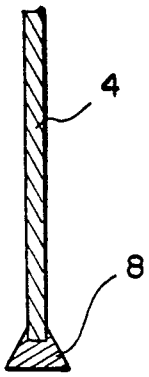
FIG. 5 is a cross-sectional view of the lower part of a stem, including the anchoring member.

To assembly the candelabrum, a number of stems 4 including their anchoring members 8 are slid into respective slots 10 and moved to the desirable positions. The anchoring members 8 of the stems 4 constitute a constraint preventing vertical or tilting movement, but providing one degree of freedom in translation, i.e., allowing horizontal movement along the slots 10. The above constraining effect can be obtained using anchoring members 8 of different shapes, as shown, by way of example, in FIGS. 6*a–c*, with the undercuts 12 of the bases 2 obviously of the matching shape. The anchoring members of FIGS. 6*a–c* have grooves 14 for brazing them to the stems 4 in the manner illustrated in FIG. 5.

Figure 6A:
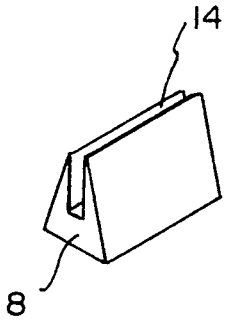
FIGS. 6*a–e* are five embodiments of the anchoring members for the stems.
Figure 6B:
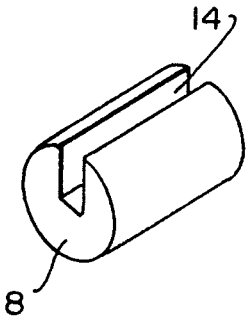
Figure 6C:
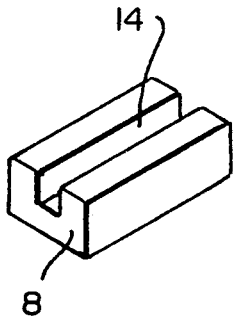
Figure 7:
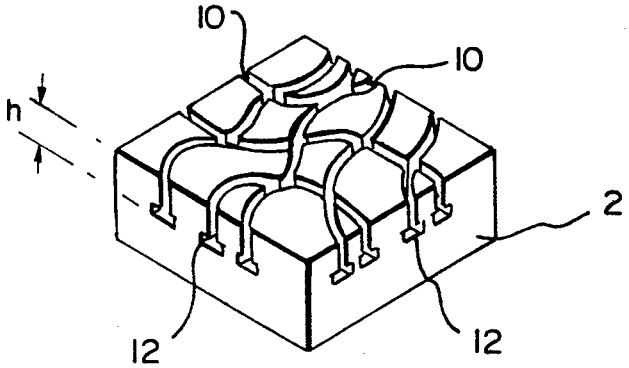
FIG. 7 represents the base of a candelabrum according to the invention, with curved, meandering slots.

FIG. 7 represents a base 2 with a slot pattern composed of curved, meandering slots 10 having undercuts 12 of a rectangular cross-section. Clearly, neither the flat stems 4 of FIG. 4 nor the prismatic or cylindrical anchoring members of FIGS. 6*a–c* are suitable for movement inside the curved slots 10 of this base.

Figure 6D:
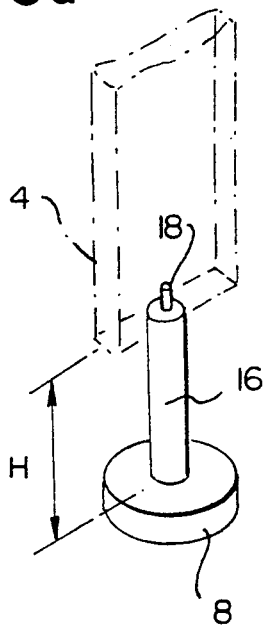
Figure 6E:
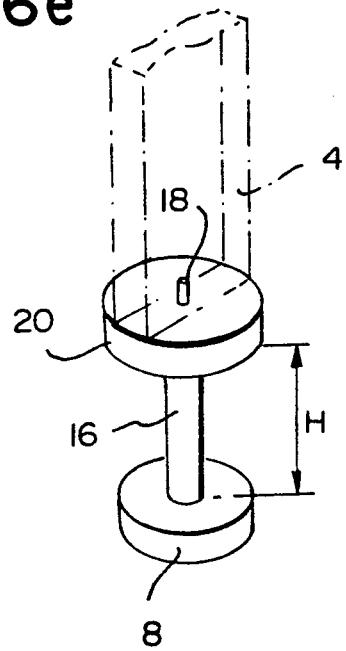

Suitable arrangements for this type of base are shown in FIGS. 6*d* and 6*e*. In FIG. 6*d*, the anchoring member 8 is of a discoid shape fitting the rectangular undercut 12 of the base of FIG. 7. The anchoring member 8 is integral with a cylindrical column 16, to the end of which is brazed the lower end of the stem 4. A locator pin fitting a corresponding bore in the stem 4 helps to position these two parts during brazing.

To provide a minimal clearance for sliding, the distance H between the upper surface of the anchoring member 8 and the lower surface of the stem 4 must clearly be slightly larger than the distance indicated in FIG. 7.

A more solid arrangement is shown in FIG. 6*e*, in which the stem 4 is brazed not to the column 16, but to a pedestal 20 which can be discoid as shown, but may be of any other shape as well. Brazing is assisted either by the pin arrangement already explained above, or by a groove of some depth (not shown) into which fits the end of the stem 4.

With the anchoring members 8 of an appropriate shape yet always solids of revolution, the arrangements of FIGS. 6*d*, 6*e* can also be used with the straight-slot bases 2 of FIGS. 2 and 3, where they would equally bestow the benefit of an additional degree of freedom in rotation not afforded by the anchoring members 8 of FIGS. 6*a–c*. This feature would add further possible configurations of the candelabrum according to the invention.

For further facilitating the sliding movement of the stems within the slots, the sliding surfaces of the stems and/or slots can be made of, or lined with, a self-lubricating material, e.g. PTFE.

Clearly, the base 2 of FIG. 7 can also have undercuts 12 of profiles other than rectangular.

While all the bases shown are square, they may have other geometries as well.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A variable-configuration candelabrum comprising:

a base provided with a plurality of constraining means of a first type defining a grid-like pattern of linear slots cut in an upper surface of the base and extending to at least one side of said base, said slots further having an undercut and a plurality of stems, each of which has a first end provided with constraining means of a second type defining an anchoring member matching said undercut and fixedly attached to each of said stems, a second end of said stems being provided with means for holding candles, said constraining means of the first type being cooperatively engageable by said constraining means of the second type from at least on side of the base for selective displacement of said stems into a plurality of positions on said base and for preventing vertical and tilting movement of said stems relative to said base.

2. The candelabrum as claimed in claim 1, wherein said slots form a mutually intersecting curvedly meandering pattern.

3. The candelabrum as claimed in claim 1, wherein said anchoring member is prismatic and is provided with a slot for attachment to said stem.

4. The candelabrum as claimed in claim 1, wherein said anchoring member is cylindrical and is provided with a slot for attachment to said stem.

5. The candelabrum as claimed 1, wherein said anchoring member is a discoid.

6. The candelabrum as claimed in claim 1, wherein said anchoring member is connected to a lower end of said stem by a substantially cylindrical column slidingly fitting in said slots.

7. The candelabrum as claimed in claim 6, further comprising a pedestal interposed between said cylindrical column and the lower end of said stem.

* * * * *